US007645123B1

(12) United States Patent
Liang

(10) Patent No.: US 7,645,123 B1
(45) Date of Patent: Jan. 12, 2010

(54) TURBINE BLADE WITH TBC REMOVED FROM BLADE TIP REGION

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 449 days.

(21) Appl. No.: 11/600,443

(22) Filed: Nov. 16, 2006

(51) Int. Cl.
*F01D 5/08* (2006.01)

(52) U.S. Cl. ..... 416/241 R; 415/115; 416/97 R

(58) Field of Classification Search ..... 415/115; 416/95, 96 R, 97 A, 97 R, 241 R
See application file for complete search history.

(56) References Cited

U.S. PATENT DOCUMENTS 3,155,536 A * 11/1964 Freeman, Jr. et al. ..... 416/241 R
5,620,307 A 4/1997 Mannava et al.
5,733,102 A 3/1998 Lee et al.
6,106,231 A * 8/2000 Brainch et al. ..... 416/97 R
6,224,337 B1 5/2001 Lieland et al.
6,461,107 B1 10/2002 Lee et al.
6,461,108 B1 * 10/2002 Lee et al. ..... 416/96 R
6,602,052 B2 * 8/2003 Liang ..... 416/97 R
6,616,410 B2 * 9/2003 Grylls et al. ..... 416/224
6,634,860 B2 10/2003 Lee et al.
6,916,150 B2 * 7/2005 Liang ..... 415/115
6,991,430 B2 1/2006 Stec et al.

* cited by examiner

*Primary Examiner*—Igor Kershteyn
(74) *Attorney, Agent, or Firm*—John Ryznic

(57) ABSTRACT

A turbine blade having a squealer tip rail forming a squealer pocket on the blade tip, and a row of blade tip peripheral film cooling holes on the pressure side and suction side of the blade for cooling the blade tip rails. A TBC is applied to the pressure side and suction side walls of the blade up to the row of tip peripheral film cooling holes, leaving these surfaces uncovered. The squealer pocket is covered with TBC while the top surfaces of the tip rails are uncovered. The surface of the airfoil wall above the row of tip peripheral cooling holes is without a TBC so that the metal surface will be exposed to the layer of film cooling holes discharged from the tip peripheral cooling holes.

7 Claims, 2 Drawing Sheets

TURBINE BLADE WITH TBC REMOVED FROM BLADE TIP REGION

BACKGROUND OF THE INVENTION

1. Field of the Invention

The present invention relates generally to fluid reaction surfaces, and more specifically to an air cooled turbine airfoil with a TBC or thermal barrier coating.

2. Description of the Related Art Including Information Disclosed Under 37 CFR 1.97 and 1.98

A gas turbine engine, be it an aero engine or an industrial gas turbine engine, includes a turbine in which a plurality of stages of stator vanes and rotor blades extract energy from a hot gas flow that passes from the combustor and through the turbine. It is well known in the art of gas turbine engines that the efficiency of the engine can be increased by increasing the hot gas flow entering the turbine. However, the highest temperature obtainable to pass into the turbine is limited to the materials used in the first stage of the stator vane and rotor blades of the turbine.

Providing turbines airfoils (blades and vanes) with cooling air has been used to allow for an increase in the hot gas flow temperature without changing the materials used. Complex internal cooling circuits have been proposed that use convection cooling, impingement cooling and film cooling of the airfoils to prevent over-heating of these airfoils. A turbine airfoil designer wants to provide for maximum cooling of the airfoil while using a minimal amount of cooling air to also increase the efficiency of the engine, since the compressed air used for the internal cooling of the airfoils is typically diverted off from the compressor of the engine. This bleed off air is not used to produce work in the turbine and as such decreases the efficiency of the engine.

Another method of protecting turbine airfoils from extreme heat is to apply a thermal barrier coating (or, TBC) to selective areas of the airfoil that is exposed to the extreme hot temperature. A turbine blade also includes film cooling holes just below the blade tip on both the pressure side wall and the suctions side wall of the blade. The film cooling holes are connected to an internal cooling air supply channel within the blade and are directed to discharge the cooling air upwards and toward the blade tip edge. The TBC is applied on the blade wall from root to tip without covering up the film cooling holes.

The high temperature turbine blade tip section heat load is a function of blade tip leakage flow. A high leakage flow will induce high heat load onto the blade tip section. Thus, blade tip section sealing and cooling have to be addressed as a single problem. Prior art turbine blade tip includes a squealer tip rail which extends around the perimeter of the airfoil and flush with the airfoil wall and forms an inner squealer pocket. The main purpose of incorporating a squealer tip in a blade design is to reduce the blade tip leakage and also to provide for rubbing capability for the blade.

Prior art blade tip cooling is accomplished by drilling holes into the upper extremes of a serpentine flow cooling passage from both of the pressure and suction surfaces near the blade tip edge and the top surface of the squealer cavity. In general, film cooling holes are built into and along the airfoil pressure side and suction side tip sections from the leading edge to the trailing edge in order to provide for edge cooling for the blade squealer tip. Convective cooling holes are also built in along the tip rail at the inner portion of the squealer pocket to provide additional cooling for the squealer tip rail. Since the blade tip region is subject to sever secondary flow leakage field, this translates to a large quality of film cooling holes and cooling flow required in order to adequately cool the blade tip periphery. FIG. 1 shows a prior art turbine blade with a squealer tip cooling arrangement and the secondary hot gas flow migration around the blade tip section. The blade includes a pressure side wall 12 and a suction side wall 13, a squealer pocket 14 formed between a tip rail 15, tip cooling holes 16, and pressure side film cooling holes 17 at the periphery of the tip. A vortex flow 22 from the blade suction side is developed, and a secondary leakage flow 21 flows over the squealer tip. FIGS. 2 and 3 show a profile view of the pressure side and suction side tip peripheral cooling hole configuration for the first stage blade in a turbine. FIG. 2 shows the pressure side tip peripheral film cooling hole pattern with a row of pressure side film cooling holes extending from the leading edge to the trailing edge of the blade. FIG. 3 shows the suction side tip peripheral film cooling hole pattern spaced along the peripheral tip from the leading edge to the trailing edge of the blade. The squealer pocket is formed between the pressure side tip rail and suction side tip rail that extends along the perimeter of the blade tip.

Since the blade squealer tip rail 15 is subject to heating from the three exposed sides—heat load from the airfoil hot gas side surface of the tip rail, heat load from the top portion of the tip rail, and heat load from the back side of the tip rail—cooling of the squealer tip rail by means of a discharge row of film cooling holes along the blade pressure side and suction side peripheral and conduction through the base region of the squealer becomes insufficient. This is primarily due to the combination of squealer pocket geometry and the interaction of the hot gas secondary flow mixing. Thus, the effectiveness induced by the pressure film cooling and tip section convective cooling holes becomes very limited. In addition, a thick TBC is normally used in the industrial gas turbine airfoil for the reduction of the blade metal temperature. However, the TBC is applied around the blade tip rail which may not reduce the blade tip rail metal temperature.

The problem associated with the turbine airfoil tip edge cooling of the prior art can be alleviated by incorporating a new and effective TBC application arrangement of the present invention into the prior art airfoil tip section cooling design.

BRIEF SUMMARY OF THE INVENTION

A turbine blade for use in a gas turbine engine in which the blade includes a squealer tip with a rail forming a pocket and a row of blade tip peripheral rail film cooling holes on both the pressure side and suction side walls of the blade. A TBC is applied to the pressure side or suction side wall of the blade up to a location at the bottom of or at the mid-point of the blade tip peripheral film cooling holes. There is no TBC applied from the blade tip peripheral film cooling holes to the blade tip crown as well as on top of the tip rail. In this uncoated surface area, only an aluminize coating is applied.

Since the pressure side and suction side film cooling holes are positioned on the airfoil peripheral tip portion below the tip crown, the cooling flow exiting the film cooling holes is in the same direction of the vortex flow over the blade from the pressure side wall to the suction side wall. The cooling air discharges from the cooling holes relative to the vortex flow to form a film sub-boundary layer for the reduction of the external heat load onto the blade pressure and suction tip rail. Since there is no TBC applied on the airfoil surface from the peripheral film cooling holes to the blade tip section, the newly formed film layer will act like a heat sink and transfer the tip section heat loads from the tip crown and the back side of the tip rail to the internal cooling cavity passage and the film layer on the blade side wall above the peripheral film cooling holes. This creates an effective method for cooling of the blade tip rail and reduces the blade tip rail metal temperature. As a result, less cooling air is required from the compressor to provide for the minimum cooling which leads to increased engine efficiency.

DETAILED DESCRIPTION OF THE INVENTION

Figure 1:
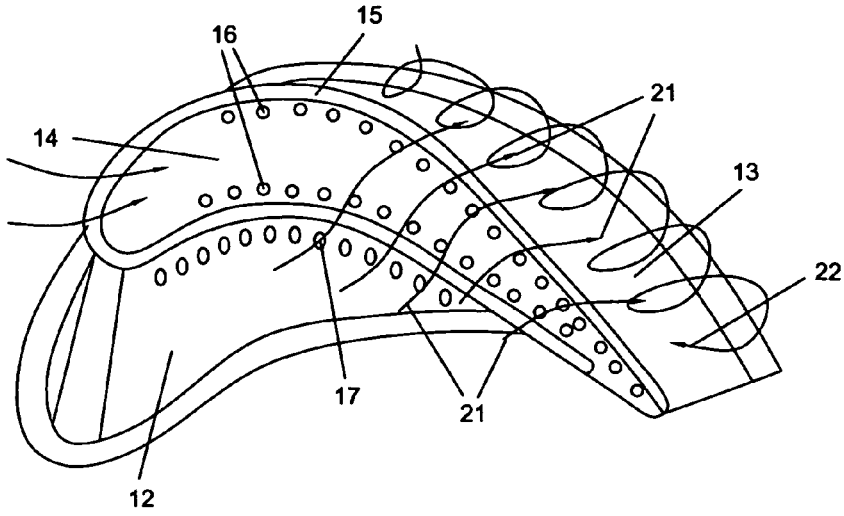
Fig 1 Prior Art
FIG. 1 shows a top perspective view of a turbine blade with a blade tip secondary flow and cooling pattern.
Figure 2:
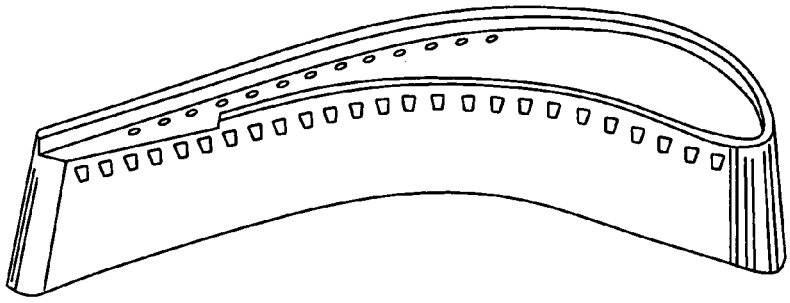
Fig 2 Prior Art
FIG. 2 shows a prior art turbine blade pressure side film cooling hole arrangement.
Figure 3:
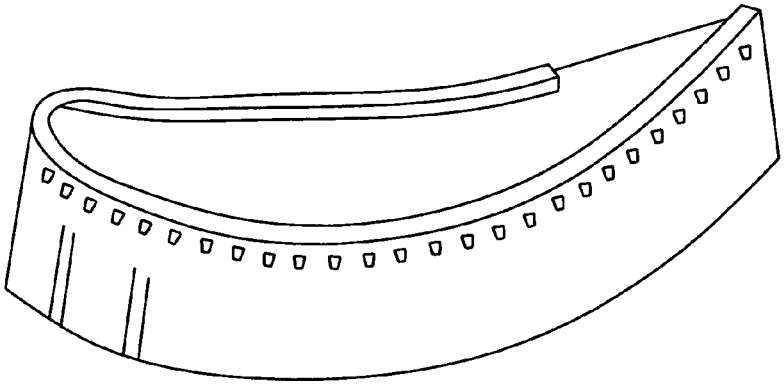
Fig 3 Prior Art
FIG. 3 shows a prior art turbine blade suction side film cooling hole arrangement.
Figure 4:
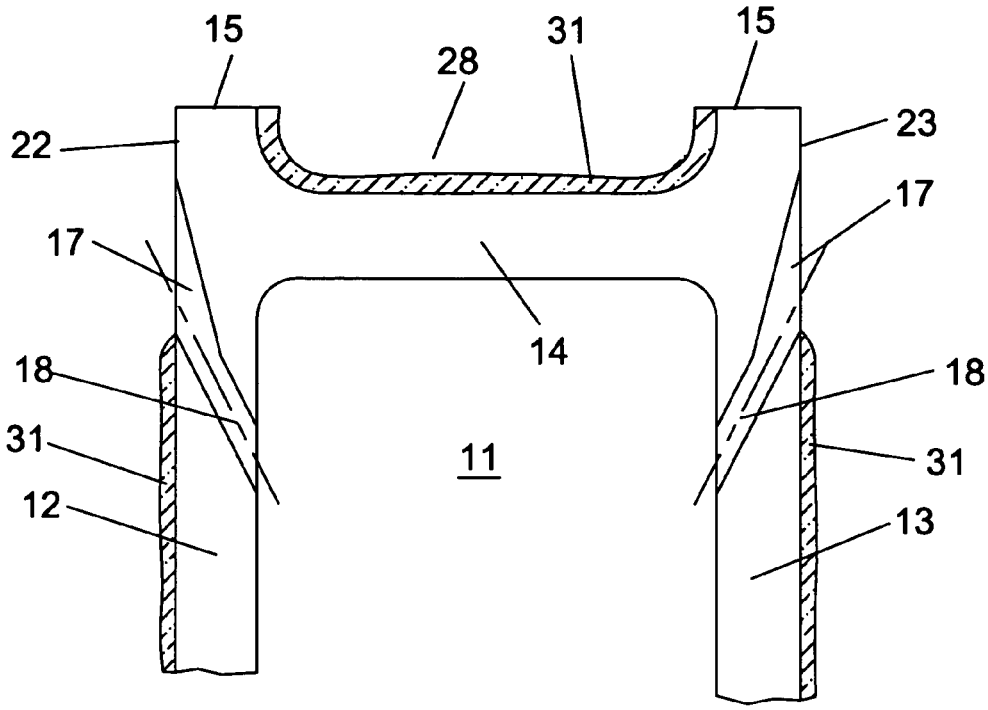
FIG. 4 shows a cross section view of the turbine blade with the film cooling hole and TBC application of the present invention.

The present invention is a turbine blade used in a gas turbine engine, in which the turbine blade includes a squealer tip and a row of blade tip peripheral film cooling holes on the pressure side or the suction side of the blade. FIG. 1 shows a side view of a cross section of the upper portion of the blade in which the pressure side wall 12 and the suction side wall 13 is shown, and the blade internal cooling passage 11 formed between the walls 12 and 13 and the blade tip 14. Film cooling holes 18 with diffuser slots 17 in the walls open into the internal cooling passage 11 and slant upward toward the blade tip to discharge cooling air as in the prior art turbine blades. The film cooling holes 18 and diffuser slots 17 used in this invention are closely spaced. A tip rail 15 extends around the perimeter of the blade and forms a squealer pocket 28. A thermal barrier coating (or, TBC) 31 is applied on the pressure side wall 12 and the suction side wall 13 up to a location about at the mid-point of the diffuser slots 17, leaving the pressure side wall and suction side wall surfaces 22 and 23 above the cooling hole diffusers 17 not coated with the TBC and exposed to the hot gas flow. The squealer pocket 28 is also applied with the TBC from tip rail to tip rail 15.

Figure 5:
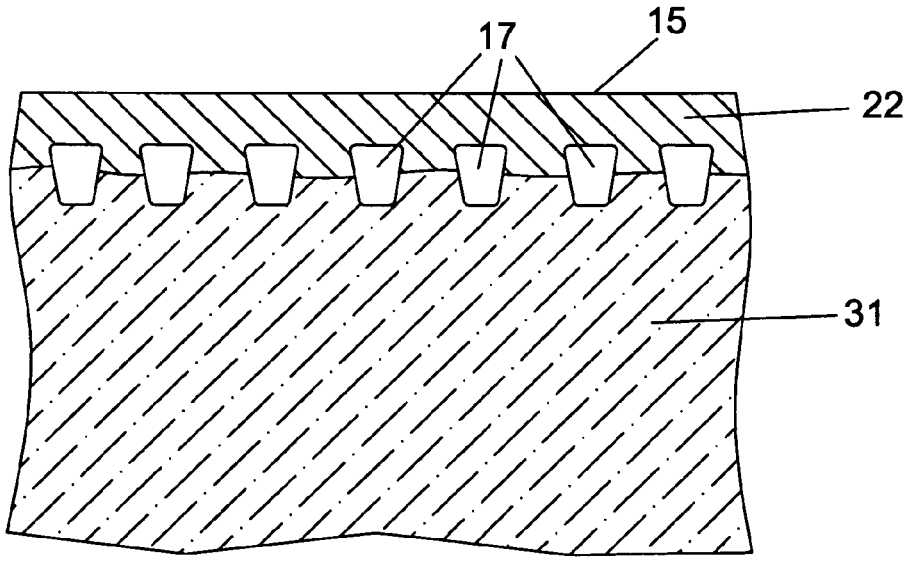
FIG. 5 shows a sectional view of the peripheral film cooling holes on the blade tip region with the TBC applied up to the film cooling holes of the present invention.

FIG. 5 shows a close-up view of the TBC applied to the pressure side wall with the TBC 31 applied up to a mid-point of the diffusers 17, and with the pressure side wall surface 22 from the mid-point of the diffusers 17 up to the tip rail 15 not covered with TBC but exposed to the hot gas flow. In another embodiment, the TBC could be applied up to the bottom of the diffuser slots 17 and still perform as described above. The diffuser slots 17 used in this invention with the uncovered wall surface above the holes are closely spaced together. The spacing of the diffuser slots 17 is such that the film cooling coverage is about 80%. If the holes were not closely spaced, then large gaps between holes with no film cooling would occur on the uncovered surface area above the holes and produce hot spots.

Because of the upper pressure side and suction side wall surfaces that are not coated with a TBC, while the tip rail sides facing the squealer pocket 16 is covered with TBC, the heat load applied to the tip rails 15 will flow along the tip rails 15 and into the internal cooling passage or toward the film cooling hole 18 and diffuser slot 17. As a result, the metal temperature of the tip rails is lower than would be the case if the entire surface was covered with TBC.

I claim the following:

1. A turbine blade comprising:

an airfoil having a pressure side wall and a suction side wall;

a squealer tip rail extending along the pressure side and suction side walls and defining a squealer pocket;

an internal cooling supply cavity formed within the airfoil walls;

a row of pressure side tip peripheral film cooling holes connected to the internal cooling supply cavity and opening onto the pressure side wall;

a TBC applied to the pressure side wall of the airfoil up to the row of pressure side tip peripheral film cooling holes such that the pressure side wall above the holes is not covered by the TBC; and, the pressure side tip rail is not covered with a TBC.

2. The turbine blade of claim 1, and further comprising:

the squealer pocket is covered with a TBC.

3. The turbine blade of claim 1, and further comprising:

a row of suction side tip peripheral film cooling holes connected to the internal cooling supply cavity and opening onto the suction side wall;

a TBC applied to the suction side wall of the airfoil up to the row of suction side tip peripheral film cooling holes such that the suction side wall above the holes is not covered by the TBC; and, the pressure side tip rail is not covered with a TBC.

4. The turbine blade of claim 1, and further comprising:

the film cooling holes open into diffuser slots; and, the TBC is applied up to about the mid-point of the diffuser slots.

5. The turbine blade of claim 1, and further comprising:

the film cooling holes slant upward toward the tip rail such that the hot gas flow is pushed up and over the tip rail on the pressure side.

6. The turbine blade of claim 1, and further comprising:

the uncovered surface above the peripheral film cooling holes and the tip rail has an aluminized coating applied thereto.

7. The turbine blade of claim 1, and further comprising:

the row of film cooling holes is closely spaced together such that the film coverage is about 80%.

* * * * *